US006372192B1

(12) United States Patent
Paulauskas et al.

(10) Patent No.: US 6,372,192 B1
(45) Date of Patent: Apr. 16, 2002

(54) CARBON FIBER MANUFACTURING VIA PLASMA TECHNOLOGY

(75) Inventors: Felix L. Paulauskas, Knoxville; Kenneth D. Yarborough, Oak Ridge; Thomas T. Meek, Knoxville, all of TN (US)

(73) Assignee: UT-Battelle, Inc., Oak Ridge, TN (US)

( * ) Notice: Subject to any disclaimer, the term of this patent is extended or adjusted under 35 U.S.C. 154(b) by 0 days.

(21) Appl. No.: 09/493,474

(22) Filed: Jan. 28, 2000

(51) Int. Cl.[7] ..... D01F 9/12

(52) U.S. Cl. ..... 423/447.7; 423/447.1; 204/155

(58) Field of Search ..... 423/447.1, 447.7; 264/29.6; 204/157.43, 157.47, 155, 156

(56) References Cited

U.S. PATENT DOCUMENTS

| | | | |
|---|---|---|---|
| 3,607,063 A | 9/1971 | Granby et al. | |
| 3,764,662 A | 10/1973 | Roberts, Jr. | |
| 3,841,079 A | 10/1974 | Ram et al. | |
| 4,197,282 A | 4/1980 | Bailly-Lacresse et al. | |
| 4,684,336 A | 8/1987 | Brotz | 425/8 |
| 5,211,923 A | 5/1993 | Harknes et al. | |
| 5,705,233 A | 1/1998 | Denes et al. | |
| 5,710,413 A | 1/1998 | King et al. | |
| 5,908,539 A | 6/1999 | Young et al. | |

FOREIGN PATENT DOCUMENTS

DE 19749475 A1 5/1999

OTHER PUBLICATIONS

Dellow et al., "Materials," Advanced Composites Bulletin (Apr. 1999).

Delmonte, J., "Technology of Carbon and Graphite Fiber Composites," pp. 40–87 (1981).

Donnet et al., "Carbon Fibers," 3 (revised and expanded), pp. 179–189 (1998).

Dresselhaus et al., "Synthesis of Carbon/Graphite Fibers", Graphite Fibers and Filaments, ch. 2, pp. 12–34 (1998).

Kroschwitz, "Carbon Fibers," High Performance Polymers and Composites, Encyclopedia Reprint Series, pp. 20–45 (1991).

Ohanian, H.C., "The Resistivity of Materials," Physics, pp. 637–639 (1985).

Peebles, L.H., "Carbon Fibers from Acrylic Precursors," Carbon Fibers Formation, Structure, and Properties, ch. 3, p. 7–25 (1995).

Peebles , L.H., Carbon Fibers Formation, Structure, and Properties, pp. 128–135(1995).

*Primary Examiner*—Stuart L. Hendrickson
(74) *Attorney, Agent, or Firm*—Quarles & Brady, LLP

(57) ABSTRACT

The disclosed invention introduces a novel method of manufacturing carbon and/or graphite fibers that avoids the high costs associated with conventional carbonization processes. The method of the present invention avoids these costs by utilizing plasma technology in connection with electromagnetic radiation to produce carbon and/or graphite fibers from fully or partially stabilized carbon fiber precursors. In general, the stabilized or partially stabilized carbon fiber precursors are placed under slight tension, in an oxygen-free atmosphere, and carbonized using a plasma and electromagnetic radiation having a power input which is increased as the fibers become more carbonized and progress towards a final carbon or graphite product. In an additional step, the final carbon or graphite product may be surface treated with an oxygen-plasma treatment to enhance adhesion to matrix materials.

8 Claims, 14 Drawing Sheets

VIII - Fortafil fiber finished product

VIII - Fortafil fiber finished product

VIII - Fortafil fiber finished product

Fortafil fiber finished product, VIII
Numbered samples are microwave/plasma processed

CARBON FIBER MANUFACTURING VIA PLASMA TECHNOLOGY

STATEMENT REGARDING FEDERALLY SPONSORED RESEARCH OR DEVELOPMENT

The disclosed invention was made with Government support under contract DE-AC05-96OR22464, awarded by the United States Department of Energy to Lockheed Martin Energy Research Corporation. The United States Government has certain rights to this invention.

CROSS-REFERENCE TO RELATED APPLICATIONS

Not Applicable.

FIELD OF THE INVENTION

The present invention relates to the production of carbon and/or graphite fibers. More particularly, the present invention relates to a method for carbonizing and/or graphitizing carbon fiber precursors using plasma technology and electromagnetic irradiation.

BACKGROUND OF THE INVENTION

Carbon and graphite fibers are commonly used as reinforcement materials in advanced structural composites. Advanced structural composites are generally lightweight and possess superior strength and elasticity over most metals. Because of these characteristics, highly advanced composites are now regularly utilized as structural members in the aerospace industry and in high-tech space applications. The use of these composites in other commercial industries, however, has seen limited application due to the high material costs associated with carbon and graphite fibers and the lack of rapid and efficient techniques for their manufacture. Currently, only moderate-cost fibers have found common application in broad consumer markets. These markets typically include the construction of items such as tennis rackets, fishing poles, and golf clubs.

Carbon and graphite fibers are produced through the controlled pyrolysis of fibrous organic carbon precursors such as polyacrylonitrile (PAN), pitch (petroleum or coal tar), or rayon. Generally, rayon-based precursors are used to produce low modulus carbon fibers (fibers having a modulus $\leqq 50$ GPa, or $7\times10^6$ PSI) while PAN or liquid crystalline (mesophase) pitch precursors are used to make the higher modulus carbon fibers (fibers having a modulus $\geqq 200$ GPa, or $7\times10^6$ PSI) used in advanced composites. Of these precursors, the PAN precursor is generally preferred due to its high carbon yield and unique mechanical properties which intrinsically avoid the need for an expensive final "graphitization" step.

The process for manufacturing carbon and graphite fibers is generally a lengthy and expensive process. The conventional process begins by spinning the carbon precursor into a fiber form using any one of several different spinning techniques. Once set in fiber form, the carbon fiber precursor is typically subjected to a stabilization step wherein the fiber is heat-treated in air and at relatively low temperatures (approximately 200° C. to 350° C. or higher). As a result of this stabilization step the outer layers or regions of the fiber are converted to an infusible and thermally stable structure capable of withstanding the high processing temperatures necessary for carbonization to a carbon or graphite form. Depending upon the stabilization process conditions employed, the stabilization process may also result in the conversion of the entire fiber to a fully stabilized form.

To form carbon or graphite fibers, the stabilized carbon fiber precursor is fired in an inert atmosphere at extremely high temperatures while under tension. Carbon fibers are generally achieved by firing at temperatures between 1000° C. and 2000° C., while higher modulus carbon fibers (graphite) normally require firing at temperatures in excess of 2500° C. The high temperatures cause the initial organic material in the fiber to convert into carbon while the fiber's noncarbon elements are expelled in the form of volatile gases. This off-gas stream is toxic and includes substantial amounts of HCN, $NH_3$, $N_2$, and $H_2O$ with lesser amounts of low molecular-weight nitriles, $CO_2$, $CH_4$, CO and $H_2$. Because of the toxic nature of the off-gas stream, treatment by liquid-phase scrubbing or catalytic combustion is required before venting. Typically, the entire carbon/graphite manufacturing process is performed in multiple and sequential conventional graphite brick-lined furnaces and may require hours to complete.

Following carbonization, the carbon or graphite fiber is usually surface treated to enhance its ability to adhere to a sizing agent and a matrix material, usually a polymeric resin. The matrix serves to bind the fibers together, forming a coherent structure and providing a medium for transferring applied stresses from one fiber to another. The matrix material affects the composites high temperature mechanical properties, transverse strength and moisture resistance, as well as other properties, and is a key factor in toughness, shear strength, and oxidation and radiation resistance. The matrix system also strongly influences the fabrication process and associated parameters for forming intermediate and final products from the composite materials.

Untreated carbon and/or graphite fiber surfaces usually have low surface energies which limit their ability to form strong adhesive bonds with matrix materials. Surface treatments applied to these fibers are able to overcome this limitation by increasing the fiber's surface activity and surface energy. These treatments typically include surface modification processes such as anodic oxidation, electrodeposition, wet and dry oxidation, plasma etchings, coatings, ion implantations, and more. Of these processes, low pressure plasma processing has offered a very attractive and efficient method for modifying the fiber's surface activity without affecting its bulk properties.

Plasma surface treatment of fully processed (fully carbonized) fibers is a well known technology previously discussed at length by J. C. M. Peng et al., "Surface Treatment of Carbon Fibers," *Carbon Fibers, Third Edition*, 180–187 (J. B. Donnet et al., ed., 1998); L. H. Peebles, "Plasma Treatment," *Carbon Fibers Formation, Structure, and Properties*, 128–135 (1995); and J. Delmonte, "Surface Treatment of Carbon/Graphic Fibers," *Technology of Carbon and Graphite Fiber Components*, 189–191 (1981), incorporated herein by reference. In the typical plasma treatment, the surface concentration of polar (oxygen-containing) groups on the filly carbonized or filly or partially graphitized fiber surface are increased by exposure to an oxygen-plasma treatment. The increased polarity, in turn, leads to both higher epoxy adhesive wetability and stronger intrinsic adhesion across the adhesive/composite interface. Under normal processing conditions, the plasma surface treatment results in extensive modifications to the outmost few atomic layers of the substrate while leaving the bulk properties of the fiber intact.

Currently, over 30,000 tons of carbon fibers are produced annually throughout the world. Although this number may seem substantial, the commercial industry has yet to realize the potential widespread use of carbon fibers because of the high costs associated with their production as compared to other materials. The most significant cost factors include the high cost of carbon precursors (45–50% of production costs), the high cost of equipment and energy consumption (20–25% of production costs), and the time expense associated with producing a quality product. In regards to the latter factor, attempts to speed the process has often resulted in the rapid burn off of the noncarbon elements which, in turn, creates bubbles and cracks in the fiber. These bubbles and cracks substantially weaken the fiber's mechanical properties such that the fibers are rendered incapable of use for their desired purpose.

U.S. Pat. No. 4,197,282, discloses a technology which is intended to reduce the costs associated with producing carbon fibers from natural organic materials, such as petroleum distillation residues or coal. In this process, carbonized and/or graphitized fibers are manufactured from natural organic precursors using a preparatory thermal treatment step and microwave irradiation. In its application, the natural organic material is spun into a fibrous carbon precursor and then heat treated in an inert atmosphere at a temperature between 300° C. and 1500° C. in a conventional furnace. The preparatory thermal treatment produces an initial carbonization which allows an interaction between the microwaves and the fibers. As with the conventional process, the inert atmosphere is obtained by using a gas which does not react with the fibers and is resistant to the temperatures reached, e.g., nitrogen, argon, helium or hydrogen. This process may also include giving the fibers an initial oxidation stabilization treatment at a temperature between 100° C. and 250° C.

After the preparatory thermal treatment, the fibers are subjected to carbonization treatment by irradiation with microwaves. The irradiation by microwaves may be carried out immediately or else discontinuously by storing the thermally pre-treated fibers and then irradiating them later. The irradiation by microwaves is carried out by electromagnetic radiation whose frequency is between 900 MHz and 30,000 MHz and preferably between 2000 MHz and 15,000 MHz, and with a power between 50 W and 10 kW. The fibers obtained by this process are said to have breaking strengths of between 1,000 and 10,000 kgf/cm$^2$.

Unfortunately, this technology has its limitations. First and foremost is the fact that the technology is limited solely to the use of natural organic raw materials and is not effective in producing other synthetic carbon fibers, such as PAN-based fibers. Moreover, the process requires a thermal pre-treatment step wherein the fibers are heated by conventional means to a temperature near the precursor's carbonization point. This pre-treatment step is necessary to increase the inherently poor coupling efficiency to the electromagnetic field. Although this abbreviated temperature treatment does not utilize the high temperature range as seen in conventional carbonization processes, the general use of a conventional furnace and the subsequent transition to a microwave field is typically inefficient and maintains the high costs associated with conventional processes.

In the absence of new and more efficient processes for manufacturing carbon fiber-based composites, the benefits associated with their use will go unrealized in other commercial industries. For example, within the domestic automobile industry there lies a growing interest in developing carbon fiber-based composites for use in primary structural applications. The use of advanced composites, if practical, would provide significant weight savings in manufactured vehicles, thereby increasing the vehicle's fuel efficiency, while maintaining the high strength and high modulus mechanical properties necessary for consumer protection.

BRIEF SUMMARY OF THE INVENTION

It is a principle object of the present invention to provide a novel method for manufacturing carbon and/or graphite fibers that will reduce the costs associated with their manufacture and allow widespread commercial use of advanced composites reinforced with carbon or graphite fibers.

It is another object of the present invention to provide a method for producing carbon and/or graphite fibers that does not require carbonization by heat treatment in high temperature furnaces.

It is yet another object of the present invention to provide a method for utilizing plasma technology and electromagnetic radiation to manufacture carbon and/or graphite fibers.

These and other objects are achieved by the present invention. The present invention is summarized in that it provides a novel method for producing carbon and/or graphite fibers utilizing plasma technology and electromagnetic radiation. The present invention also includes carbon and/or graphite fibers so obtained. Specifically, the present invention discloses a method for producing carbon and/or graphite fibers wherein stabilized carbon fiber precursors are placed in an oxygen-free atmosphere, under slight tension and/or physically restrained, and subjected to both a plasma energy and a level of electromagnetic radiation which is increased as the fibers progress towards a final carbon or graphite product. The plasma is generated in a controlled oxygen free plasma chamber using an oxygen free inert gas capable of acting as a carrier for the generated effluents of the processing system. The electromagnetic radiation is generated by a standard electromagnetic generator capable of providing electromagnetic radiation within the microwave frequency range and a power input between 250 W and 100 kW.

In its practice, the stabilized carbon fiber precursors are physically restrained and/or placed under slight tension and subjected to the plasma in the plasma chamber. The plasma in the plasma chamber interacts with the stabilized carbon fiber precursor and initiates the pyrolysis process in the fiber while increasing the fiber's dielectric loss tangent and consequently raising the fiber's coupling efficiency to the electromagnetic radiation. Through this coupling, a uniform application of electromagnetic energy is achieved throughout the fiber's cross-section, the uniform application of electromagnetic energy results in uniform and homogeneous volumetric heating which promotes the mass exchange of oxygen and evolved gases across the entire cross-section of the fiber. These gases are released in the form of off-gases and serve as an indicator for increasing the level of electromagnetic energy or the completion of carbonization. In an additional step, oxygen may be carefully introduced into the chamber after the fibers are carbonized or fully or partially graphitized to surface treat the carbon or graphite product to assist in matrix adhesion.

It is an advantage of the present invention that carbon and/or graphite fibers are capable of being manufactured according to the disclosed method from a wide range of carbon fiber precursors. In addition, the present method is capable of producing carbon and graphite fibers having a wide range of final properties as a function of the processing parameters utilized.

It is another advantage of the present invention that carbon and graphite fibers are capable of being produced without requiring additional heat-treatment steps beyond stabilization as required in other carbonization or graphitization processes.

It is still another advantage of the present invention that off-gases produced during the carbonization process are further used to supplement the plasma reaction and drive carbonization, thus reducing the amount of volatile gases present in the effluent gas stream and the amount of volatile gases requiring purification prior to venting.

It is still yet another advantage of the present invention that the disclosed method allows the production of surface treated carbonized or graphitized products in a single process step.

It is yet another advantage of the present invention that PAN-based fibers produced according to the disclosed method have a modulus of elasticity near half that of steel, a strength fifty percent greater than common structural steel, and a density that is near twenty percent that of steel.

Other objects, features, and advantages will become apparent upon consideration of the following detailed description of the preferred embodiments considered in light of the attached drawings.

DETAILED DESCRIPTION OF THE INVENTION

Figure 1:
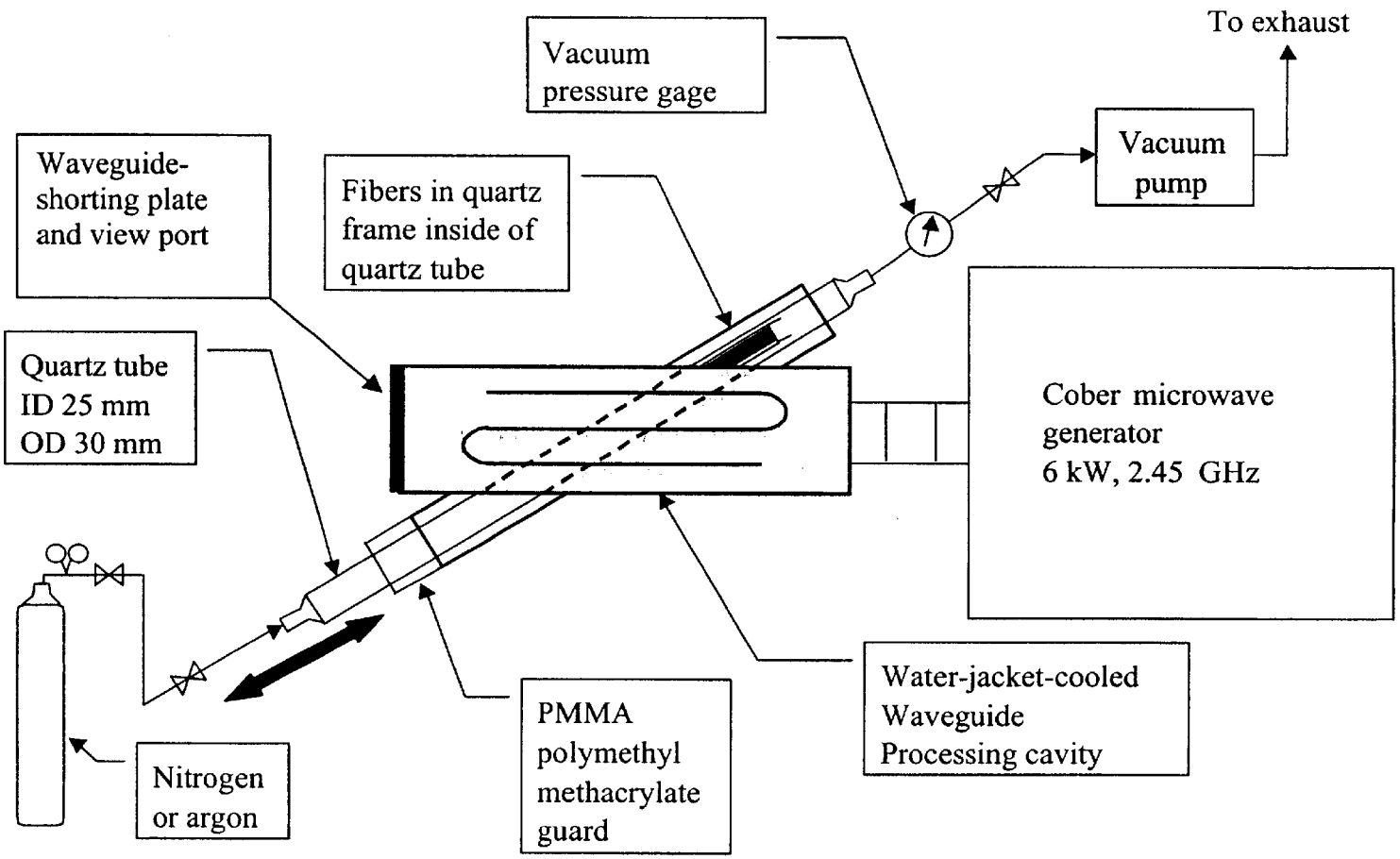
FIG. 1 is a general illustration of a fiber carbonization system capable of batch processing carbon fiber precursors using plasma and electromagnetic radiation.

The method of the present invention utilizes plasma technology in connection with electromagnetic radiation to produce carbon and/or graphite fibers from stabilized carbon fiber precursors. In general, the stabilized carbon fiber precursors are placed under slight tension, in an oxygen-free atmosphere, and carbonized using a plasma and electromagnetic radiation whose power input is increased as the fibers become more carbonized and progress towards a final carbon or graphite product.

Carbon and graphite fibers according to the present invention originate from stabilized carbon fiber precursors. Stabilized carbon fiber precursors are generally defined as carbon precursors previously spun into fiber form and fully or partially stabilized by a stabilization process effective in preparing the carbon fiber precursor for carbonization.

Such fibers and the methods of their manufacture are well known in the art and generally include, without limitation, rayon-based fibers, PAN-based fibers, pitch-based fibers, or any other fiber spun from material capable of being converted into carbon when heat-treated to temperatures in excess of 500° C. Preferably, the carbon fiber precursor is either a PAN-based or a pitch-based precursor, and more preferably a PAN-based precursor.

The term "plasma" is used to identify gaseous complexes which may comprise electrons, positive or negative ions, gaseous atoms and molecules in the ground state or any higher state of excitation including light quanta. In the preferred embodiment of the present invention, the plasma is considered a low pressure "cold" plasma and generally comprises gas atoms at room temperature and electrons at much higher temperatures. This plasma state provides an ambient gas temperature along with electrons which have sufficient kinetic energy to cause the cleavage of chemical bonds.

Preferably, the generation of the plasma is initiated by an alternating current, direct current or radio frequency discharge, but may also be initiated and sustained by any plasma sustaining energy commonly known in the art. Most preferably, the plasma is initiated and sustained by electromagnetic frequency discharges. In the preferred embodiment, the plasma is generated by an excess of the required electromagnetic radiation to process the stabilized carbon fiber precursors.

The plasma utilized in the present invention is generated and maintained in a controlled oxygen free plasma chamber having the capacity to control the introduction of inert gases or the removal of off-gases from the chamber so as to allow control of the internal pressures induced by the carbonization process. The plasma can also be applied by an external source e.g., plasma plume or torch. The inert gases utilized in the present invention may include any oxygen-free gas capable of maintaining a plasma reaction and serving as a carrier for the effluents generated by the carbonization system. Examples of such gases include, without limitation, argon, nitrogen, helium, hydrogen, or any mixture thereof The electromagnetic radiation is preferably produced by an electromagnetic generator capable of producing an electromagnetic discharge in the electromagnetic frequency range and at power levels sufficient to carbonize the stabilized carbon fiber precursors according to the present invention. The irradiation by electromagnetic discharges is preferably performed using electromagnetic radiation whose frequency is between 3 KHz and 300 GHz and more preferably between 0.5 GHz and 300 GHz. The power input by the electromagnetic radiation is preferably between 250 W and 100 kW, and more preferably between 500 W and 15 kW.

The method of the present invention begins by preparing the stabilized carbon fiber precursor for carbonization. This preparation step generally requires placing the stabilized carbon fiber precursors under slight tension. Alternatively, the stabilized carbon fiber may be placed in a restraining fixture where it is physically restrained such that the carbon fiber will come under tension as the carbonization process proceeds. The tension will ensure the proper alignment of the fiber's internal structure and the production of high modulus carbon fibers with the inducement of the carbonization process. The type of tension system utilized will ultimately depend upon whether carbonization is performed using a batch process or a continuous process. Such processes are well known in the art and generally described by R. Diefendorf, in "Carbon/Graphite Fibers," *Engineering Materials Handbook: Composites* 38–42 (1987).

The prepared stabilized carbon fiber precursors are then introduced into the controlled oxygen-free plasma chamber where they are subjected to the plasma and electromagnetic radiation in an atmosphere of oxygen-free inert gas. The plasma is initiated at any time during this process by an electrical discharge or an induced dielectric breakdown and will depend primarily upon the processing system utilized. In the preferred embodiment, this discharge is created by a high level electromagnetic frequency discharge generated by the electromagnetic generator. The plasma formed in the plasma chamber interacts with the stabilized carbon fiber precursor, initiating the pyrolysis of the fiber and increasing the fiber's dielectric loss tangent (tangent $\delta$). The raising of the fiber's tangent $\delta$, in turn, increases the fiber's coupling efficiency to the electromagnetic radiation.

As the stabilized carbon fiber precursor interacts with the plasma, it is subjected to increasing levels of electromagnetic radiation input power. The irradiation preferably uses electromagnetic radiation within the frequency range between 3 KHz and 300 GHz, and more preferably radiation within the microwave frequency range (0.5 GHz and 300 GHz). The input power of the radiation is preferably between 250 W and 100 kW, and more preferably between 500 W and 15 kW, and will depend upon several factors including, among others, the particular stabilized carbon fiber precursor utilized, the tow of the fibers as they are processed, and the extent of carbonization desired in the final product.

The coupling of plasma and electromagnetic radiation generates a uniform application of electromagnetic energy throughout the fiber's cross-section, resulting in uniform and homogeneous volumetric heating of the carbon precursor material. This heating promotes the mass exchange of oxygen and evolved gases across the entire cross-section of the fiber. As the input power of electromagnetic radiation is increased, the heating temperature across the fiber's cross section is also increased. This increase in heating temperature results in filcher carbonization of the fiber's organic elements and the release of additional noncarbon off-gases. The released off-gases, in turn, serve as additional fuel for the plasma and will eventually be partially consumed by the reaction or extracted from the chamber in an effluent gas stream.

The released off-gases also serve as a good indicator of whether carbonization is complete or whether an increase in the input power is necessary. For example, as the fiber is first exposed to the plasma and the electromagnetic radiation, the fiber reaches a temperature wherein a portion of its initial organic material is converted to carbon, resulting in the release of off-gases. The release of these off-gases will continue until the temperature of the fiber generated by that particular power level is unable to further carbonize the fiber's organic material. At that time the power level provided by the electromagnetic radiation is increased to raise the temperature of the fiber and continue the carbonization process. The release of the off-gases will result in an initial increase in pressure within the plasma chamber. As the fiber ceases to release these off-gases, and as the previously released off-gases are consumed by the plasma or extracted by vacuum in the effluent gas stream, the pressure in the chamber once again returns to its normal level. The return to this normal level indicates that the temperature of the fiber generated by that particular power level is no longer carbonizing the fiber and an increase in power level is warranted or that the carbonization is complete and a final carbon or graphite product has been produced.

The carbon and/or graphite fibers obtained by the method of the present invention are generally equivalent or comparable to final conventionally graphitized materials. A comparison between the typically evaluated fingerprint properties of these two technologies (electrical resistivity, intrinsic density, bulk density, filament diameter, tow area, etc.) show excellent correspondence between fibers obtain using plasma and electromagnetic radiation and conventionally processed materials.

Fully processed PAN fibers obtained by the present method, without surface treatment or sizing, may generally have an ultimate tensile strength ranging between 203–344 ksi, a Young's Modulus between 16.3–27.91 Msi, and an elongation failure in a range of 0.73–0.95%. This equates to a modulus of elasticity near half that of steel, a strength 50% greater than common structural steel, and a density that is near 20% that of steel. Accordingly, the method of the present invention makes it possible to obtain relatively cheap composite materials having an improved mechanical strength with a wide range of mechanical and physical properties.

The fibers also have the added feature of being somewhat surface treated upon completion of the process. The off-gases released by the carbonization of the stabilized carbon fiber precursor will often contain small amounts of particles which, when consumed by the plasma, will have a similar effect upon the surface of the fiber as those utilized in individual plasma surface treatments. As such, most fibers may not require the addition of surface treatments to ensure proper matrix adhesion.

An additional step, however, may be added to the present method to ensure a complete surface treatment has occurred. In this final step, a small level of oxygen is carefully introduced into the plasma chamber after the fibers are carbonized or fully or partially graphitized (i.e., having both a carbon and a graphite crystalline structure). This oxygen is then consumed by the plasma resulting in the treatment of the carbon or graphite fiber surface in a manner typically utilized in commonly known plasma surface treatments. Caution must be taken, however, to avoid introducing too much oxygen into the chamber as excess oxygen may result in a negative thermal reaction and loss of the fiber product.

Suitable plasma reaction conditions are set forth below in the Examples. Aside from the general guidelines described herein, one of ordinary skill in the art is sufficiently familiar with plasma conditions to adjust the reaction to accommodate different precursor materials, gases, and carbonization systems, and produce carbon fibers.

Although the description above and the examples below discuss the production of carbon and graphite fibers using a single plasma chamber and a single source of electromagnetic radiation, it is anticipated that a series of plasma chambers or a series of electromagnetic generators may be utilized to practice the disclosed method in a continuous process. These processes may include, without limitation, a continuous flow process similar to a kiln type application with no physical separation between stages in processing, or a continual sequence process having discrete processing stages.

By way of illustration, examples of the method of the present invention are described below and should not be construed to limit the scope or spirit of the invention. Likewise, this invention is not limited to the preferred embodiments and alternatives heretofore described, to which variations and improvements may be made.

EXAMPLE 1

Quasi-Batch Plasma/Microwave System

A quasi-batch processing system was constructed to produce carbon and graphite fibers using plasma and microwave radiation. A microwave chamber was designed such that a quartz tube plasma chamber was capable of being placed at an angle through a microwave resonant cavity, as shown in FIG. 1. The quartz tube, having a nominal outer diameter of 30 mm and a wall thickness of either 2.1 mm or 1.5 mm, was designed to provide a tightly controlled oxygen free plasma chamber capable of containing a fibrous carbon precursor sample. The chamber was supplied with an oxygen free inert gas (nitrogen or argon) at one end and possessed a vacuum controlling pressure levels and extracting gas effluents at the other end. A Cober Microwave generator having a 2.45 GHz single frequency and a maximum input power of 6 kW was employed to provide the electromagnetic radiation. This single frequency microwave applicator provided sufficient energy to carbonize and graphitize PAN-fibers.

Figure 2:
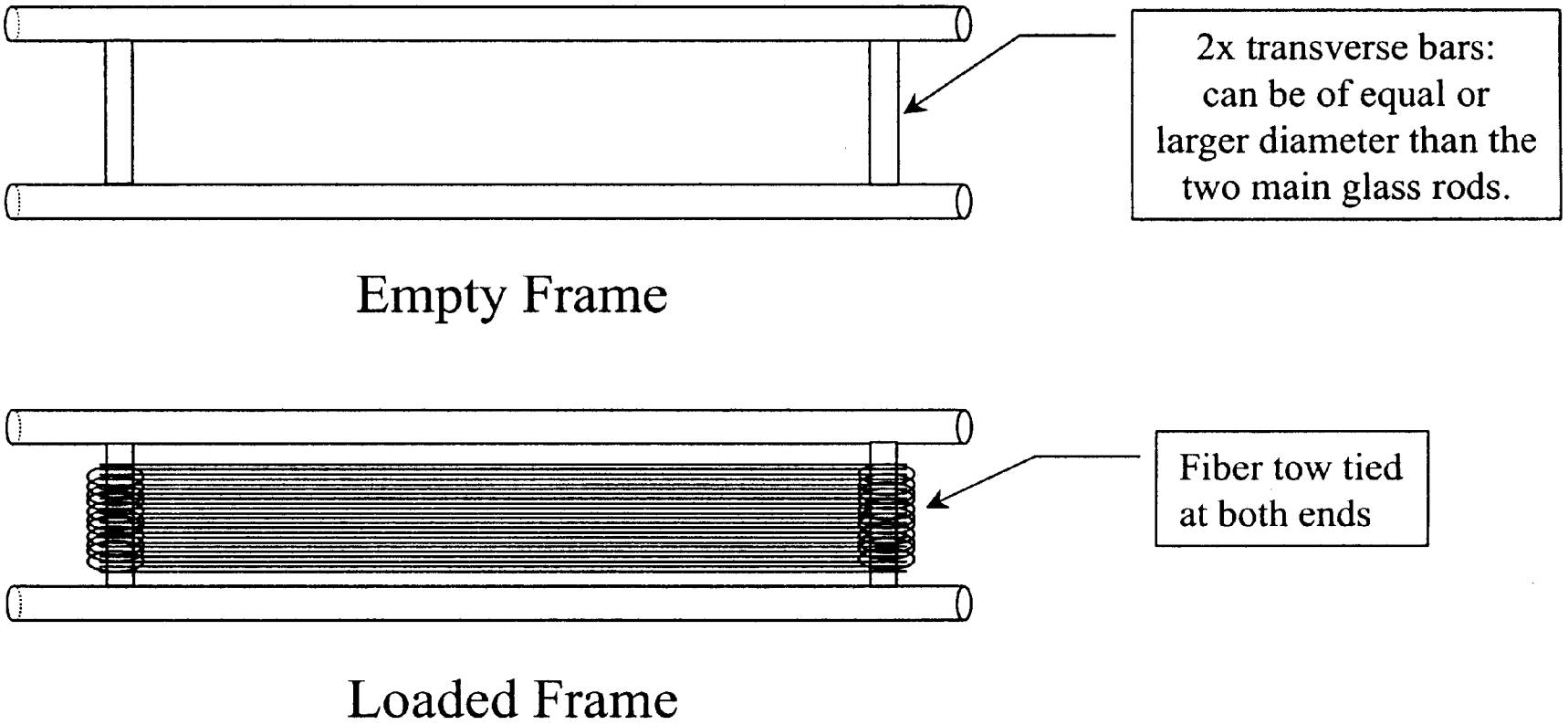
FIG. 2 is a general illustration of a double H frame fiber holder generally used in batch processing systems to physically restrain the stabilized carbon fiber precursors under tension.

Fibers were wrapped around a double H frame manufactured using a fused quartz rod having a rod thickness of 2.1 mm or 1.5 mm, as shown in FIG. 2. A single 50 K tow strand was used with the fiber tied at both ends of the H frame so that the cross-section remained 50 K. By being physically restrained, and due to the natural shrinkage experienced during carbonization, the fibers automatically came under tension. The normal length of these fibers was between 12 inches and 24 inches. Because of the limited size of the resonant cavity as compared to the size of the chamber and double H frame, the maximum possible sample length inside the applicator (i.e., exposed to the electromagnetic field) at any time was approximately 9 to 10 inches.

Plasma/Microwave Carbonization

Several batches of filly oxidized AKZO PAN-based fibers having a nominal tow size of 50,000 (50 K) filaments were carbonized utilizing the apparatus as described above. The plasma was generated in the plasma chamber by slowly increasing the microwave input power until a visible light blue-reddish plasma was initiated. The input power from the microwave generator was then reduced to a minimum power sufficient to maintain the plasma and initiate carbonization. Typically, the initial power level ranged between 400 W Table 1.

TABLE 1

Carbon Fiber Processing Conditions

| Sample | Initial Fiber wt. | | | | | | | | Percent Wt. Loss |
|---|---|---|---|---|---|---|---|---|---|
| 5 | 6.01 g. | Power Input (Watts) | 400 | 500 | 600 | 700 | 800 | 900 | 43.0% |
| | | Minutes | 7 | 5 | 5 | 5 | 5 | 5 | |
| 8 | 4.10 g. | Power Input (Watts) | 700 | 1000 | 1400 | 1700 | — | — | 45.0% |
| | | Minutes | 5 | 5 | 7 | 3 | — | — | |
| 9 | 4.70 g. | Power Input (Watts) | 800 | 1200 | 1500 | 2000 | — | — | 51.3% |
| | | Minutes | 5 | 5 | 5 | 5 | — | — | |
| 15 | 4.52 g. | Power Input (Watts) | 750 | 1000 | 1400 | 2000 | — | — | 44.0% |
| | | Minutes | 5 | 6 | 5 | 4 | — | — | |
| 17 | 3.80 g. | Power Input (Watts) | 600 | 800 | 1000 | 1400 | 1800 | 2000 | 50.0% |
| | | Minutes | 3 | 3 | 5 | 5 | 5 | 5 | |
| 18 | 4.40 g. | Power Input (Watts) | 700 | 1000 | 1500 | 2000 | — | — | 52.3% |
| | | Minutes | 4 | 4 | 4 | 4 | — | — | |
| 19 | 3.60 g. | Power Input (Watts) | 700 | 1000 | 1500 | 1800 | — | — | 42.5% |
| | | Minutes | 4 | 4 | 5 | 4 | — | — | |
| 21 | 4.00 g. | Power Input (Watts) | 600 | 800 | 1000 | 1400 | 1800 | 2000 | 50.0% |
| | | Minutes | 4 | 4 | 4 | 4 | 4 | 4 | |

NOTE: Initial pressure at each stage for each sample was approximately 3 to 5 Torrs.

At each stage of the process, the initial pressure within the chamber was approximately 3 to 5 Torrs. As carbonization commenced, an increase in the pressure within the chamber was realized using a vacuum pressure gauge. Maximum pressure depended upon the initial minimum input power used to initiate carbonization. After reaching its maximum pressure, the pressure levels within the chamber naturally decreased until they returned to normal levels. The return to normal levels indicated that the fiber was no longer able to convert its organic material to carbon at the present temperature and, thus, an increase in fiber temperature was necessary. To increase the fiber's temperature, the input power was increased and the process repeated until a final carbon or graphite product was achieved. See Table 1. The final fiber products achieved typically experienced a percent weight loss in the range of 43% to 53%.

The overall processing time for each sample produced varied dependant upon the various levels of input power utilized. The processing time for complete carbonization a typically ranged between 18 and 34 minutes with processing at lower input power levels resulting in the longest processing time. See Table 1. This overall processing time, however, is not indicative of the actual processing time necessary for complete carbonization. The actual processing time necessary for complete carbonization will generally be of a lesser duration than the overall processing time experienced in the present example. This is due to the fact that the microwave cavity was too small to contain the complete length of the double H frame holding the carbon fiber precursor and, thus, at any time during the carbonization process only a portion of the fiber was exposed to the microwave/plasma. The effective processing time for each sample may be estimated to one third of the sample's processing time.

EXAMPLE 2

Carbon fiber samples were produced in both a nitrogen plasma and an argon plasma. The carbon fiber produced in nitrogen plasma was processed for a period of 30 minutes while the carbon fiber produced in argon plasma was processed for 2 minutes. The carbon fiber precursor used were fully oxidized Zoltek fibers having an electrical resistivity greater than 1000 Ω-cm. The precursor fiber sample used in both cases was a 50 k filament tow fiber.

Figure 3:
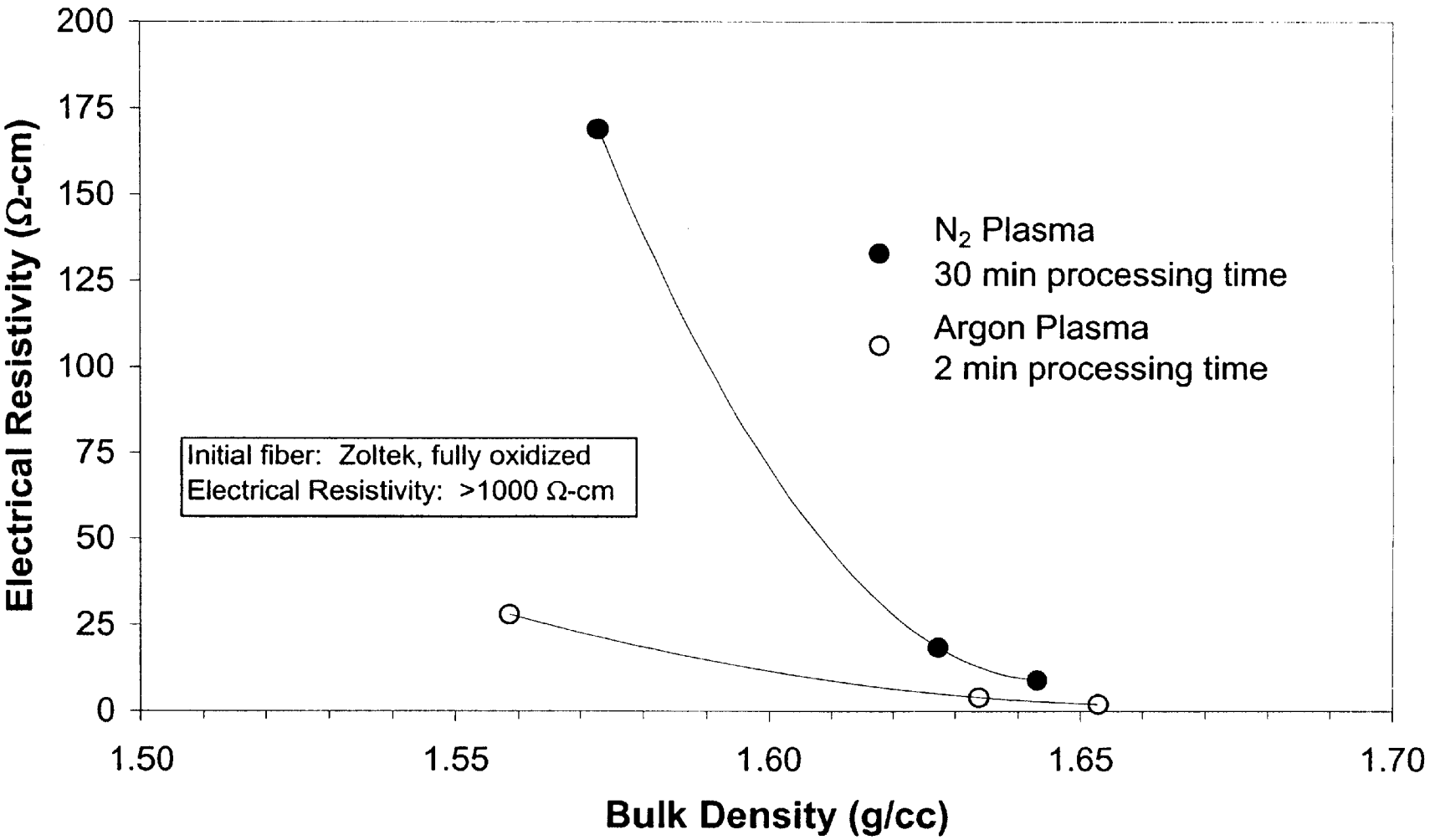
FIG. 3 is graph comparing the bulk density and electrical resistivity of fully oxidized Zoltek fibers carbonized in nitrogen plasma and argon plasma using the method of the present invention.

As shown in FIG. 3, carbonization in both a nitrogen plasma and an argon plasma was able to substantially increase the bulk density of the fibers while reducing their electrical resistivity after processing.

EXAMPLE 3

Approximately 25 different samples were produced under varying input power levels and plasma types using the apparatus and method described in Example 1 above. These samples were analyzed for variations in electrical resistivity, intrinsic density, bulk density, filament diameter, tow area, ultimate tensile strength, elongation at failure and elasticity modulus.

The results found in the processing of sample 6 are shown in FIGS. 4–8. Sample 6 originated from an approximately 24 inch long fully oxidized 50 k filament tow AKZO PAN-based fiber having an initial fiber weight of 6.2 grams. The fiber had an electrical resistivity greater than 1000 Ω-cm. This sample was carbonized in nitrogen plasma and electromagnetic radiation at sequential input power levels of 500 watts for 5 minutes, 600 watts for 6 minutes, 700 watts for 8 minutes, 800 watts for 5 minutes, 900 watts for 4 minutes and 1000 watts for 1 minute. This process resulted in a fiber having an overall weight loss of 40%.

Utilizing the fact that sample 6 was 24 inches long and the microwave cavity exposing the fiber to microwave radiation was only 9 to 10 inches long, a process gradient was established within the fiber as a function of sample length. The process gradient was established by processing one end of the fiber sample for a longer period than its opposing end as the sample was moved through the microwave cavity.

Figure 4:
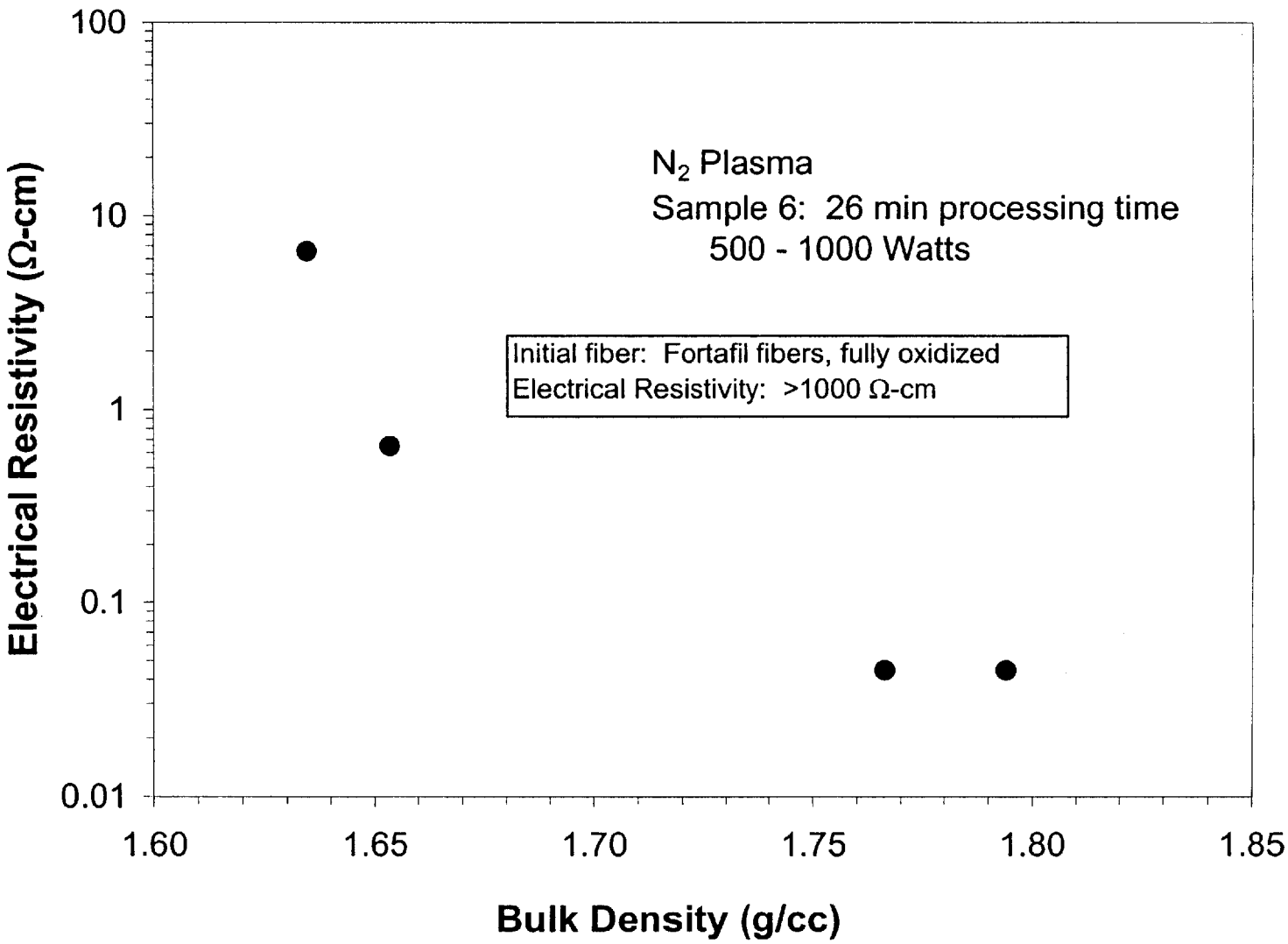
FIG. 4 is a graph showing electrical resistivity as a function of bulk density for carbonized Akzo fibers processed in nitrogen plasma for 26 minutes at a power input of 500 to 1000 Watts.
Figure 5:
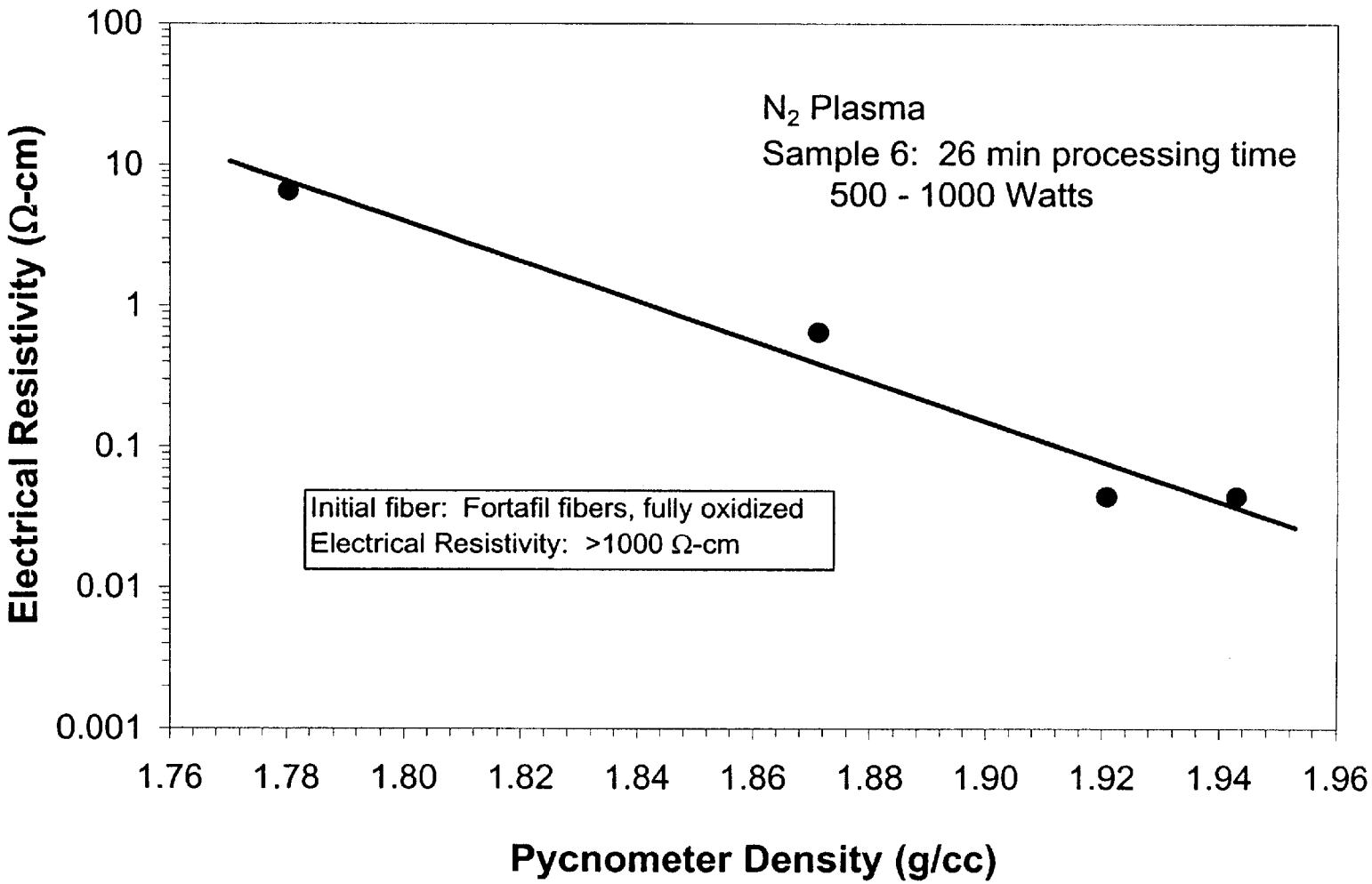
FIG. 5 is a graph showing electrical resistivity as a function of intrinsic density (pycnometer density) for carbonized Akzo fibers processed in nitrogen plasma for 26 minutes at a power input of 500 to 1000 Watts.
Figure 6:
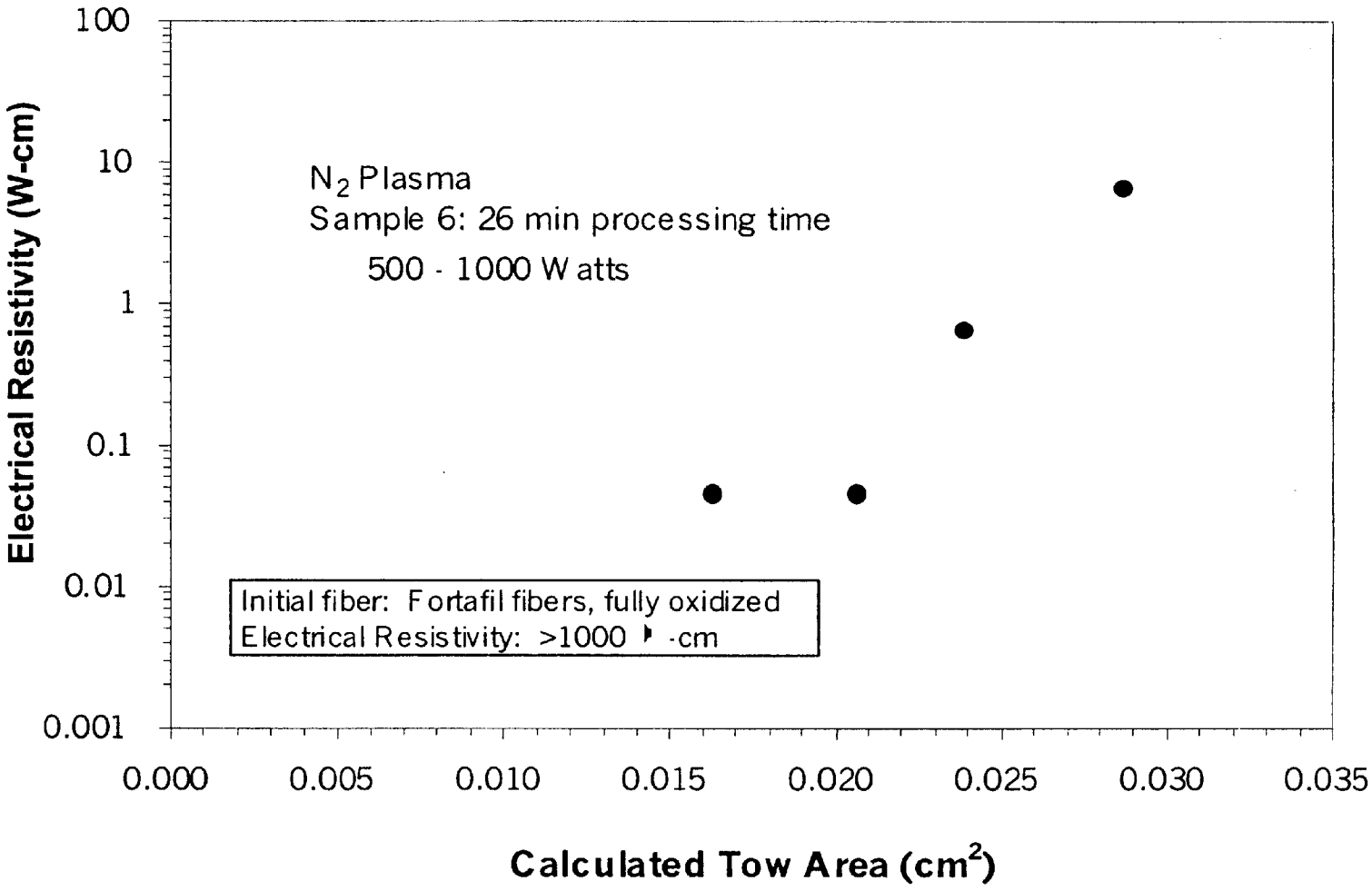
FIG. 6 is a graph showing electrical resistivity as a function of calculated tow area for carbonized Akzo fibers processed in nitrogen plasma for 26 minutes at a power input of 500 to 1000 Watts.
Figure 7:
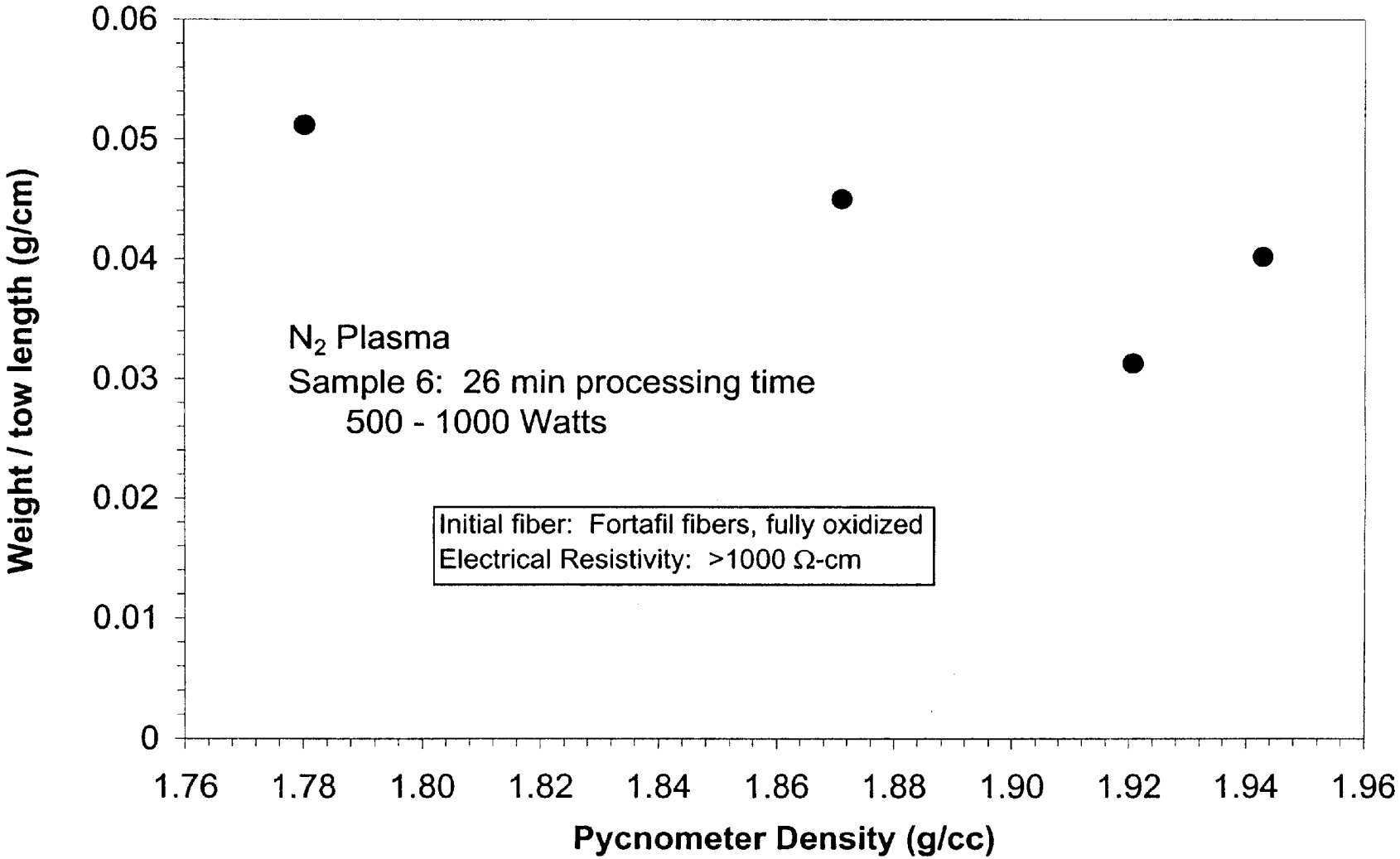
FIG. 7 is a graph showing the weight per tow length (linear density) as a function of intrinsic density for carbonized Akzo fibers processed in nitrogen plasma for 26 minutes at a power input of 500 to 1000 Watts.
Figure 8:
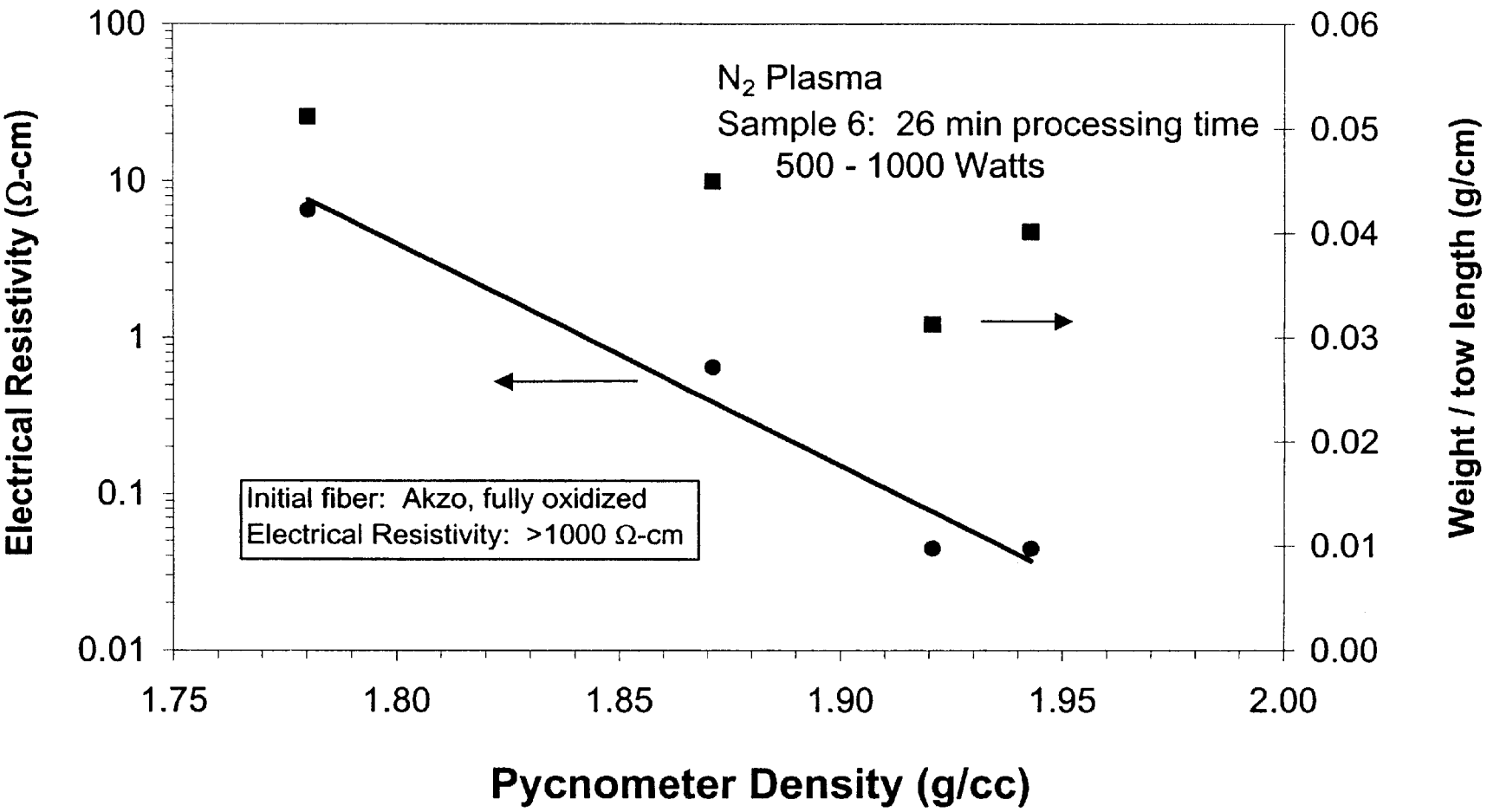
FIG. 8 combines the data of FIGS. 5 and 7.

In general, it can be stated that with increasing processibility an increase in both bulk and pycnometer density is associated with a reduction in the electrical resistivity, calculated tow area, and weight per tow length. FIGS. 4, 5, and 6 illustrate evaluations made along four points of the sample relative to the processing gradient. FIGS. 4 and 5 depict electrical resistivity as a function of the bulk density and intrinsic density (pycnometer density) respectively, at each of the four points. As shown here, the electrical resistivity of the fiber decreases as the processing length and the density increases. FIG. 6 shows how electrical resistivity varied as a function of calculated tow area. Here the electrical resistivity decreases as the calculated tow area decreases. FIG. 7 indicates how weight per tow length (linear density) varies as a function of intrinsic density. Depicted is a general decreasing trend in weight per tow length with increasing pycnometer density. FIG. 8 combines the data of FIGS. 5 and 7.

Figure 9:
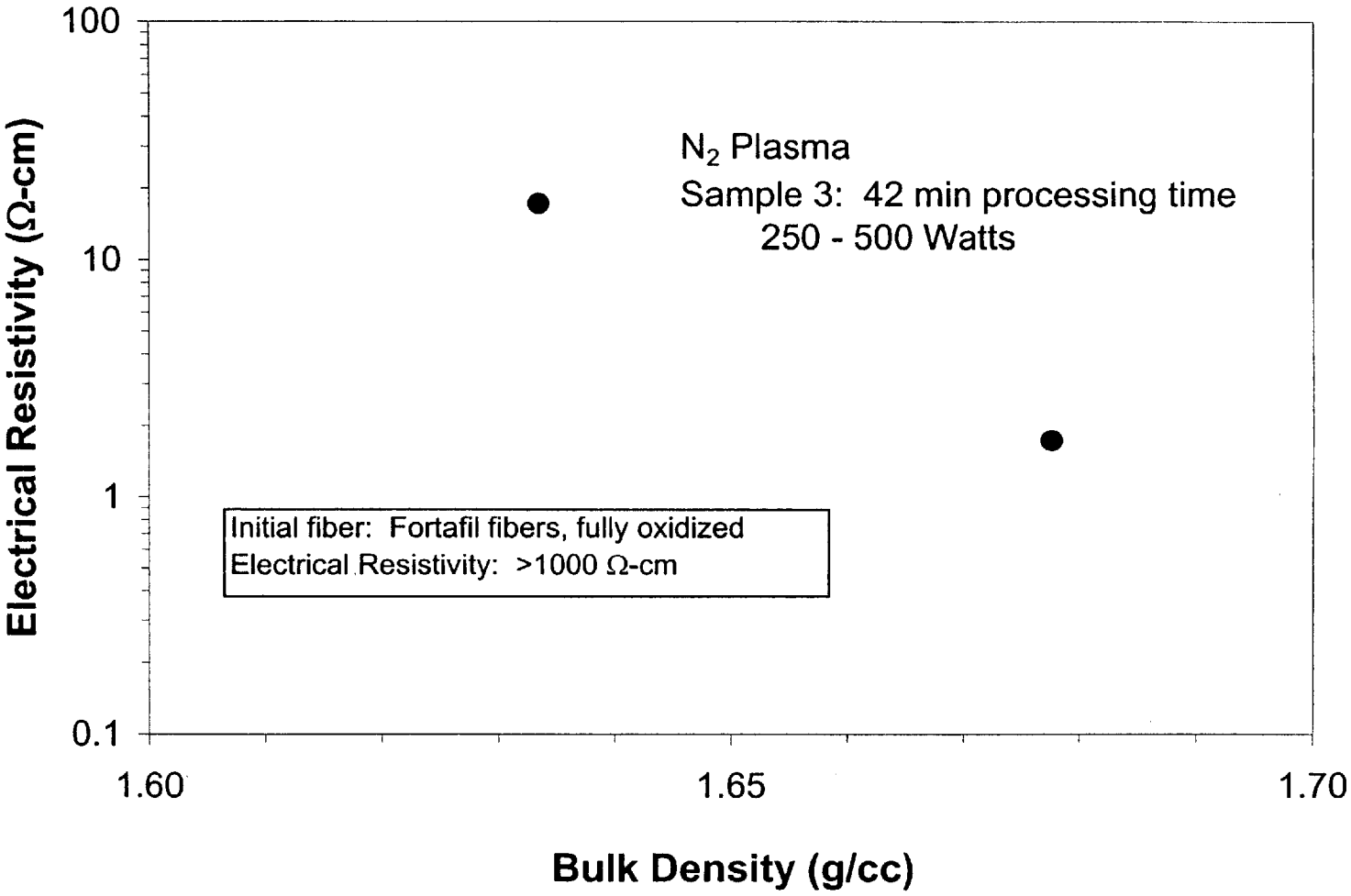
FIG. 9 is a graph showing electrical resistivity as a function of bulk density for carbonized Akzo fibers processed in nitrogen plasma for 42 minutes at a power input of 250 to 500 Watts.

Sample 3 provided a similar result, as shown in FIG. 9. Sample 3 also originated from a fully oxidized 50 K filament tow AKZO PAN-based fiber having an electrical resistivity greater than 1000 Ω-cm and was also processed in nitrogen plasma. Sample 3, however, was processed over a longer period of time (42 minutes) and at a lower input power level (250 W to 500 W). Although the processing of the two samples varied, the gradient in processability is clearly recognizable.

Figure 10:
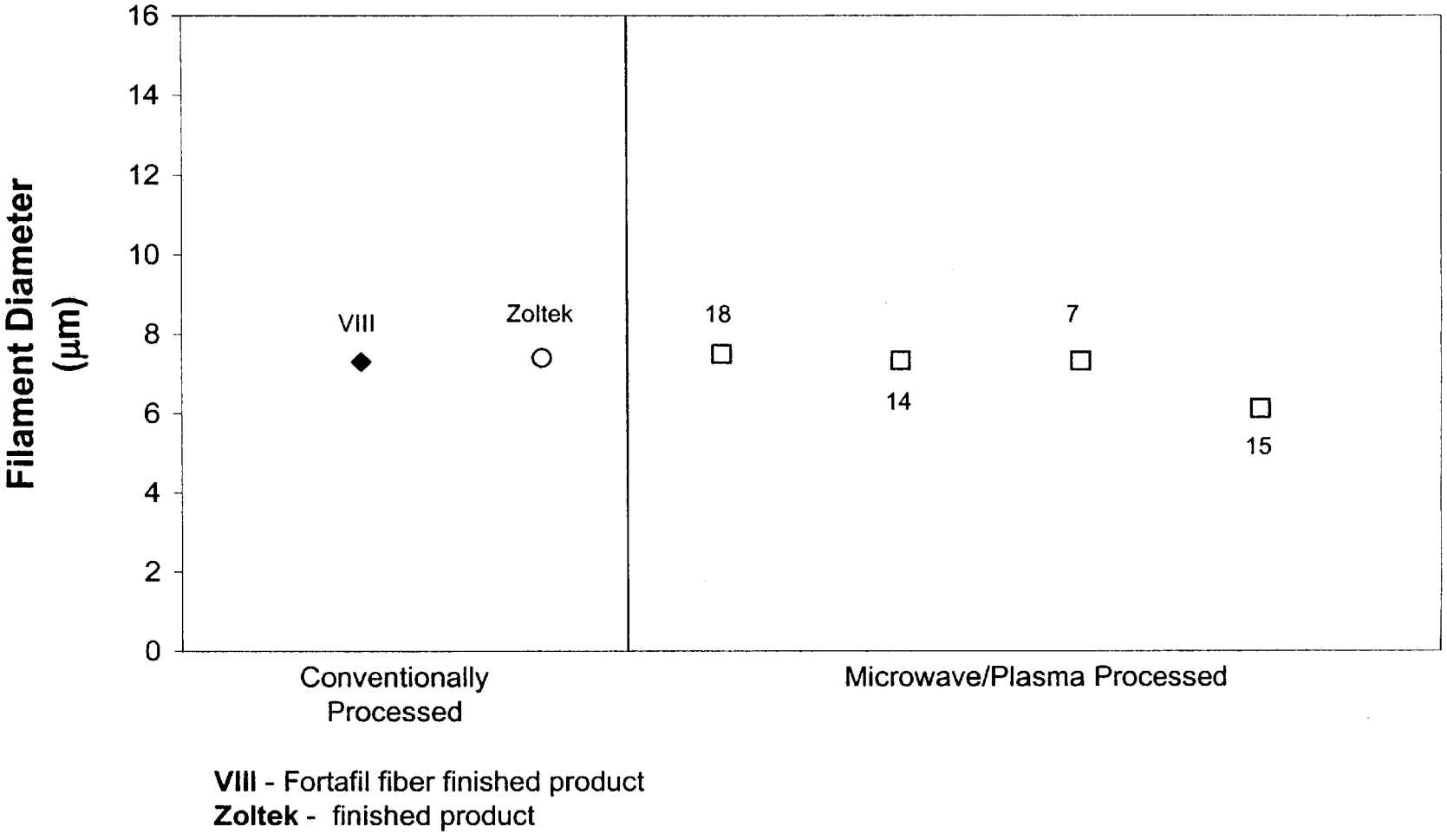
FIG. 10 is a graph showing the filament diameter of commercially available carbon fiber finished products as compared to the final fiber diameter of fibers processed according to the present invention.

FIG. 10 depicts the fiber filament diameter of two carbon fiber finished products as compared to the microwave plasma processing of samples 7, 14, 15, and 18. This data clearly indicates that the fiber filament diameter of microwave plasma process material is in agreement with the processing trend, and their value is equivalent to or smaller than the corresponding 50 K tow commercial product of AKZO and Zoltek. In some cases, filament diameters were obtained with lower values than the commercial final product.

Figure 11:
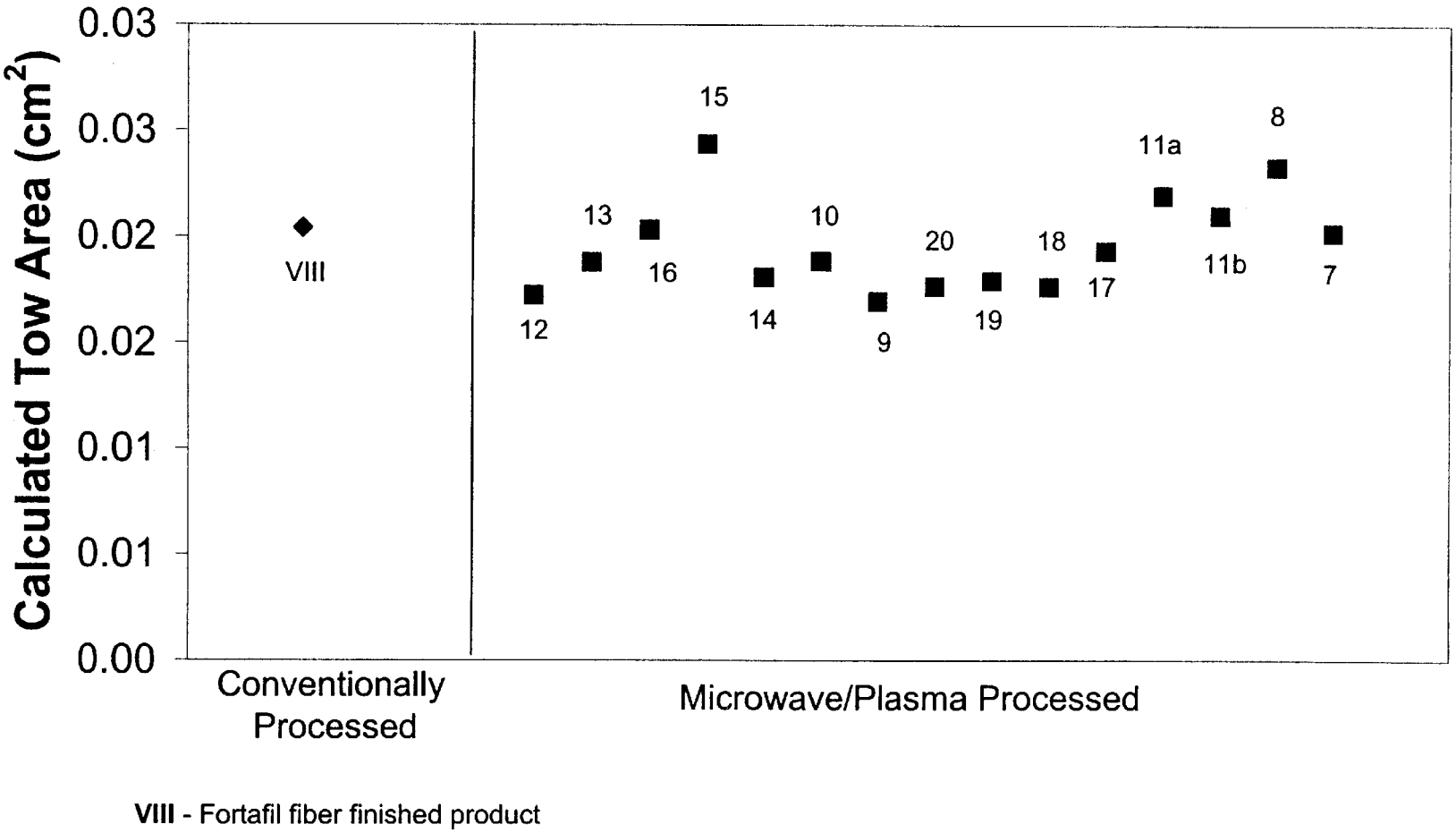
FIG. 11 depicts the overall calculated fiber tow area of commercially available carbon fiber finished product as compared to the final tow area of fibers processed according to the present invention.
Figure 12:
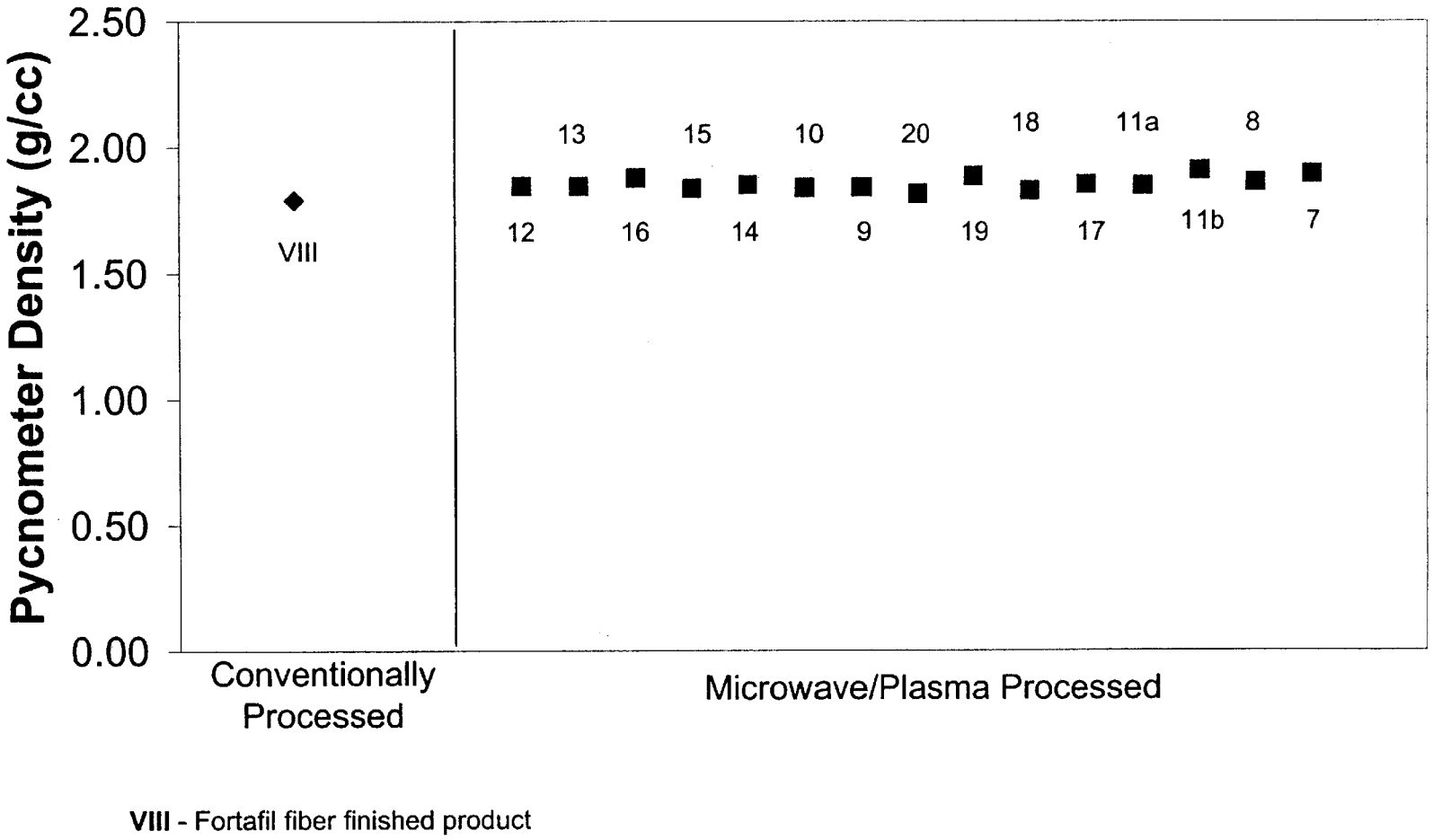
FIG. 12 is a graph showing the pycnometer density of commercially available carbon fiber finished product as compared to the final pycnometer density of fibers processed according to the present invention.

FIG. 11 depicts the overall calculated tow area of a fiber produced by the conventional process as compared to several of the samples processed using microwave plasma processing. The data clearly indicates that the values of the tow area for a large number of microwave plasma process samples match the data for the final commercial product. FIG. 12 depicts the pycnometer density (intrinsic density) of a carbon fiber finished product as compared to several of the samples processed using microwave plasma processing. It is easily seen that the microwave plasma processing material matches the highest level of conventionally processed material.

Figure 13:
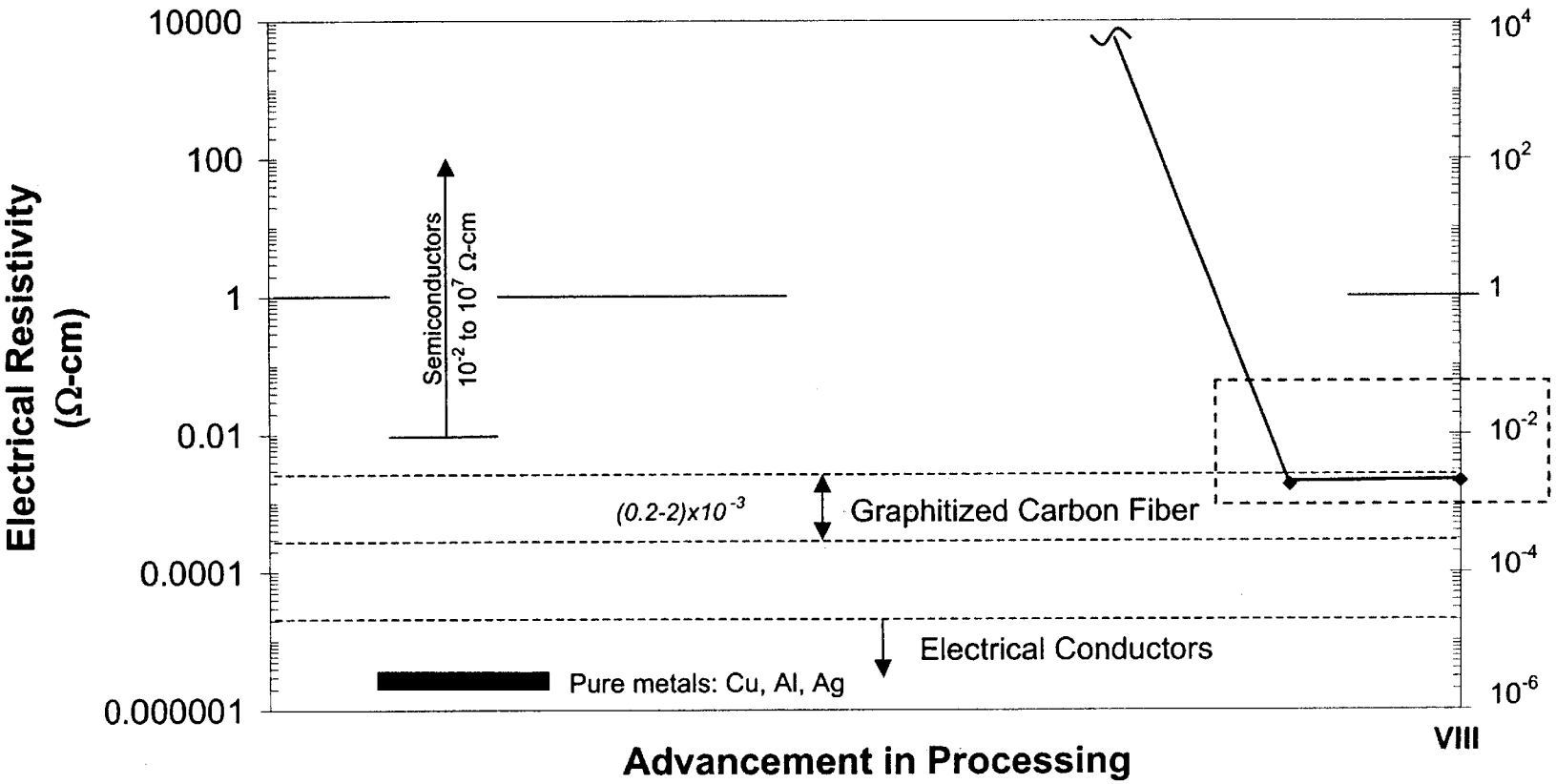
FIG. 13 is a graph illustrating fiber electrical resistivity as compared to electrical conductors and semi conductors.
Figure 14:
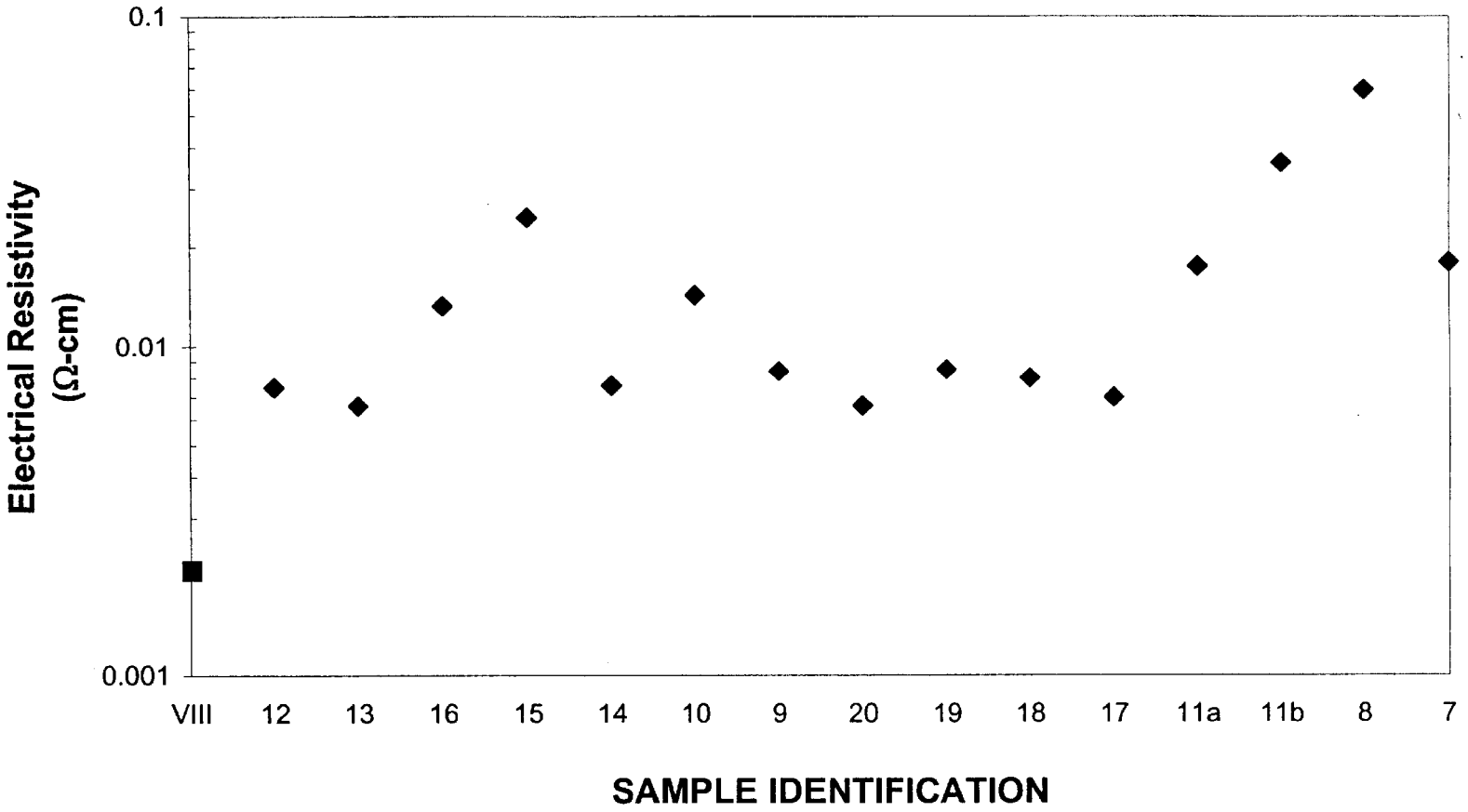
FIG. 14 is a blown up region of FIG. 13 showing the electrical resistivity of fibers carbonized according to the present invention.

FIG. 13 indicates how carbon fiber electrical resistivity compares to other metals and semiconductors. Examples of pure metals such as copper, aluminum, and silver are indicated in the figure. FIG. 14 shows a specific region of FIG. 13. This figure shows an assemblage of data points at the level below 0.01 Ω-cm. The minimum value obtained for the microwave plasma processing material was 0.006 Ω-CM which is in the range of graphitized carbon fibers. The microwave plasma processing samples were processed at different conditions thus, some dispersion in the data is observed an expected.

We claim:

1. A method for manufacturing carbon and graphite fibers comprising submitting one or more stabilized carbon fiber precursors to a plasma in an oxygen-free atmosphere while irradiating the stabilized carbon fiber precursors with an electromagnetic radiation at increasing input power levels.

2. The method of claim 1 wherein the stabilized carbon fiber precursor is selected from the group consisting of rayon-based fibers, pitch-based fibers and polyacrylonitrile-based fibers.

3. The method of claim 1 wherein the plasma originates from a gas which is nitrogen, argon, helium, hydrogen, or a mixture thereof.

4. The method of claim 1 wherein irradiation by electromagnetic radiation is performed using electromagnetic radiation having a frequency of between 3 KHz and 300 GHz.

5. The method of claim 1 wherein irradiation by electromagnetic radiation is performed using electromagnetic radiation having a frequency of between 0.5 GHz and 300 GHz.

6. The method of claim 1 wherein the input power levels are between 250 W and 100 kW.

7. The method of claim 1 wherein the input power levels are between 500 W and 15 kW.

8. The method of claim 1 comprising the additional step of introducing oxygen into the oxygen free atmosphere after the step of submitting the stabilized carbon fiber precursors to the plasma in the oxygen-free atmosphere while irradiating the stabilized carbon fiber precursors with electromagnetic radiation at increasing input power levels.

* * * * *